US007056467B2

(12) United States Patent
Kang et al.

(10) Patent No.: US 7,056,467 B2
(45) Date of Patent: Jun. 6, 2006

(54) METHOD OF PRODUCING THIN SHEET OF AL-SIC COMPOSITE MATERIAL

(76) Inventors: Suk Bong Kang, 101-902 Hyundai Apartment, Banlim-dong, Changwon-shi, Gyoungsangnam-do, 641-180 (KR); Kwang Jun Euh, 506 Korea Institute of Machinery and Materials Apartment 13-3 Gaeumjeong-dong, Changwon-shi, Gyoungsangnam-do, 641-180 (KR); Manchang Gui, BeiJing Institute of Aeronautical Materials, P.O. Box 83-1, Beijing 100095 (CN)

( * ) Notice: Subject to any disclaimer, the term of this patent is extended or adjusted under 35 U.S.C. 154(b) by 0 days.

(21) Appl. No.: 10/653,485

(22) Filed: Sep. 2, 2003

(65) Prior Publication Data

US 2004/0071896 A1 Apr. 15, 2004

(30) Foreign Application Priority Data

Sep. 11, 2002 (KR) ..... 10-2002-0054844

(51) Int. Cl.
*C23C 4/10* (2006.01)

(52) U.S. Cl. ..... 264/455; 264/682; 264/80; 156/62.2; 156/247

(58) Field of Classification Search ..... 427/452, 427/450, 456; 264/455
See application file for complete search history.

(56) References Cited

U.S. PATENT DOCUMENTS 3,596,344 A * 8/1971 Kreider ..... 29/419.1
4,749,545 A * 6/1988 Begg et al. ..... 419/13
4,824,733 A * 4/1989 Dallaire ..... 428/551
4,970,091 A * 11/1990 Buhrmaster et al. ..... 427/449

FOREIGN PATENT DOCUMENTS

JP 10-261812 * 9/1998
KR 2003-0005439 * 1/2003

* cited by examiner

*Primary Examiner*—Katherine Bareford
(74) *Attorney, Agent, or Firm*—Nelson Mullins Riley & Scarborough LLP

(57) ABSTRACT

Disclosed herein is a method for producing a thin sheet of an Al—SiC composite material, which comprises the steps of: mixing aluminum powders and SiC powders to give spraying powders; and plasma-spraying the spraying powders on a graphite substrate to form a thin sheet. According to the method of the present invention, the composite material having low thermal expansion coefficient, high thermal conductivity and low density, which is suitable for use as a thermal management material for electronic devices, can be produced by a simple production process.

2 Claims, 3 Drawing Sheets

METHOD OF PRODUCING THIN SHEET OF AL-SIC COMPOSITE MATERIAL

REFERENCE TO RELATED PATENTS AND PATENT APPLICATIONS

The present application is related to and claims priority from Korean Patent Application No. 2002-54844, filed Sep. 11, 2002, which is hereby incorporated by reference herein in its entirety.

BACKGROUND OF THE INVENTION (1) Field of the Invention

The present invention relates to a method for producing a metal matrix composite material, and more particularly, to a method for producing a thin sheet of a SiC-reinforced metal matrix composite material using plasma spraying.

(2) Background of the Related Art

The metal matrix composite material is highlighted as a thermal management material for various electronic devices, such as a heat sink for electronic packages, in that its heat transfer coefficient and thermal expansion coefficient are easily controlled according to the kind and fraction of its reinforcing material. Also, there are actively conducted studies on a method for producing composite materials using various matrix metals and reinforcing materials. Particularly, for use as the thermal management material for electronic devices, materials with the properties of low thermal expansion coefficient, high thermal conductivity, low density and low production cost are centrally developed. In case of an aluminum matrix composite material, a high fraction of the reinforcing material is essentially required to satisfy the low thermal expansion coefficient of the composite material. For example, in a SiC-reinforced aluminum matrix composite material, there is required a SiC volume fraction of about 40–70%. If the volume fraction of SiC in the SiC-reinforced composite material is less than 40%, the thermal expansion coefficient of the composite material will be excessively increased to more than $15.5\times10^{-6}/°$ C., whereas if the SiC volume fraction is more than 70%, the thermal conductivity of the composite material will be too much reduced to 149 W/m·K. Thus, the composite material containing the reinforcing material at an amount out of the range of about 40–70% will be unsuitable for use as the thermal management material for electronic packages.

In producing an aluminum matrix composite material containing a reinforcing material at a volume fraction of more than 40%, there were mainly used a pressure infiltration method or a pressureless infiltration method developed by Lanxide Technology Company, etc., which are disclosed in U.S. Pat. No. 6,228,453 and U.S. Pat. No. 5,856,025. However, such infiltration methods have significant difficulty in producing a preform, and post-production processing is substantially impossible so that subsequent processes are extremely limited. As a result, such infiltration methods has disadvantages in that production cost is increased due to a complicated production process, and also productivity is reduced. Particularly, there is significant difficulty in cutting and processing into a thin sheet shape constituting a measure of the utility of the composite material, and thus, such infiltration methods require expensive cutting and processing, including electrical discharge machining (EDM), laser cutting, processing with diamond tools, and the like.

SUMMARY OF THE INVENTION

Accordingly, the present invention has been made to solve the above-mentioned problems occurring in the prior art, and an object of the present invention is to provide a method by which a composite material having low thermal expansion coefficient, high thermal conductivity and low density, suitable for use as a thermal management material for electronic devices, particularly a composite material of a thin sheet shape, can be produced by a simple production process.

To achieve the above object, the present invention provides a method for producing a thin sheet of an Al—SiC composite material, which comprises the steps of: mixing aluminum powders and SiC powders to give spraying powders, and plasma-spraying the spraying powders on a graphite substrate to form a thin sheet.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, the present invention will be described in detail.

A producing method of a composite material according to the present invention is suitable for the production of an aluminum matrix composite material reinforced with SiC powders. Particularly, the producing method according to the present invention is suitable for the production of an aluminum matrix composite material containing SiC powders at high volume fraction, and preferably a thin sheet of an aluminum matrix composite material, which contains SiC powders at 40–70% by volume. Such a composite material is highly useful as a thermal management material for electronic packages.

In producing the composite material according to the present invention, Al powders are first mixed with SiC powders to give spraying powders. In this case, the Al powders and the SiC powders are preferably mixed such that the spraying powders contain the SiC powders at 40–70% by volume.

The mixing of the Al powders and the SiC powders may be carried out by a simple mixing method, but preferably by a mechanical method, such as ball milling. If the mixing is conducted by the ball milling, a processing aid, such as stearic acid, is preferably added.

After undergoing suitable drying, such spraying powders are formed into a thin sheet shape by using atmospheric plasma spraying.

Figure 1:
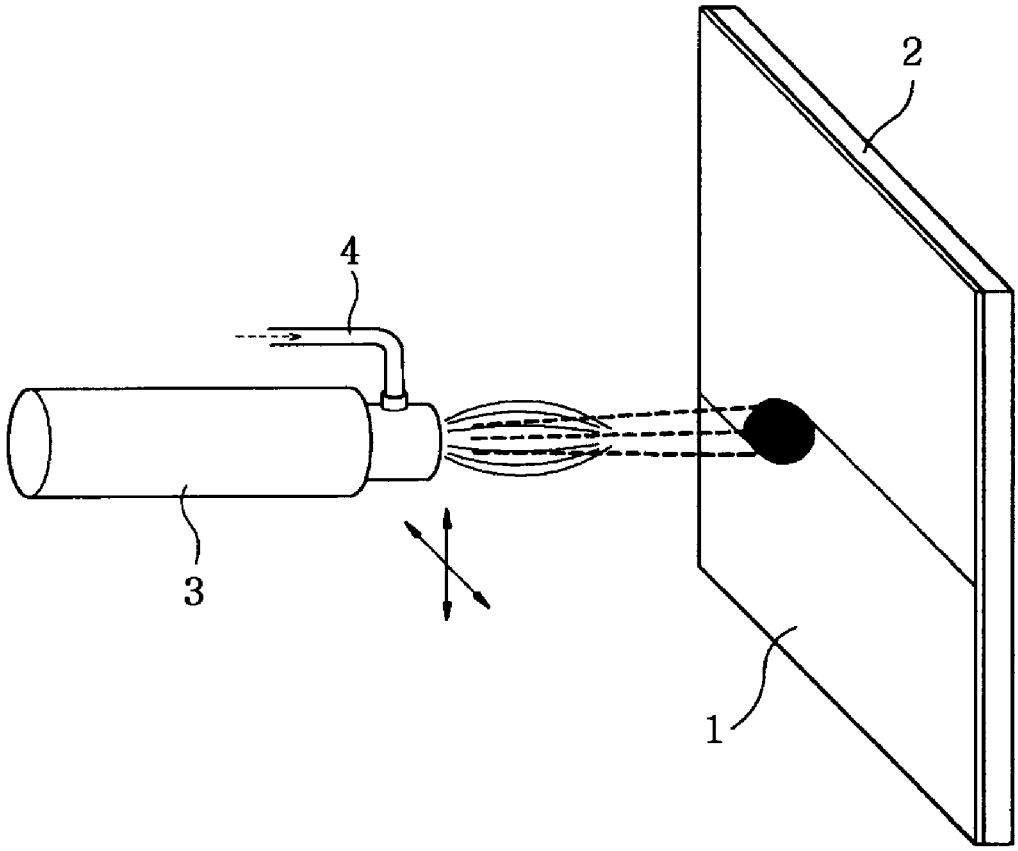
FIG. 1 is a schematic view illustrating a process for producing a thin sheet of an Al—SiC composite material according to the present invention.

FIG. 1 is a schematic view showing a process for producing the thin sheet 1 by plasma spraying. As shown in FIG. 1, the thin sheet of the composite material is produced by supplying the spraying powders toward a front end portion of a spray gun 3 through a supply section 4, and spraying the spraying powders, together with the emission of a flame, to a substrate 2 which is opposite to and located at a given distance from the front end portion of the spray gun.

The substrate 2 used in the spraying operation is preferably a graphite substrate, because it shows low wettability by aluminum and has a great difference in thermal expansion coefficient from aluminum such that the peeling of the thin sheet from the substrate is easy. The size of the thin sheet may vary depending on the size of the substrate 2. For the production of the thin sheet of a large size, if boron nitride (BN), for example, is sprayed during the spraying operation to coat the central portion of the substrate surface so that the area of the spraying powders sprayed on the substrate is maintained at a constant level, there will be no difficulty in peeling the thin sheet from the substrate after spraying.

The substrate 2 is located on a fixing member (not shown), and the plasma spray gun 3 is mounted on a movable member (not shown) such that it can be moved at constant speed according to programs.

In the plasma spraying according to the present invention, plasma arc power is preferably 20–40 kW. At a plasma arc power of less than 20 kW, the powders will not be heated to sufficient temperature, so that they will be difficult to be laminated on the substrate, thereby reducing the recovery rate of the powders. On the other hand, at a plasma arc power of more than 40 kW, defects, such as oxides, will be increased due to spraying at high temperature.

Moreover, the interval between a nozzle located at the front end portion of the spray gun and the substrate is preferably 110–130 mm. If this interval is less than 110 mm, the temperature of the substrate will be excessively increased by plasma arc, thereby degrading the stability of the spraying process, whereas if the interval is more than 130 mm, the recovery rate of the powders will be undesirably reduced due to the solidification of the molten powders.

Furthermore, the transfer rate of the spraying powders is preferably set to the range of 20–30 g/minute, and the flow rate of primary gas is preferably controlled to the range of 45–55 l/minute. If the transfer rate of the powders is less than 20 g/minutes, the amount of the sprayed powders will be too low so that this transfer rate is not preferred in view of an economical aspect. If the transfer rate of the powders is more than 30 g/min, the flow of the powders will not be smooth so that it is difficult to obtain a uniformly sprayed surface. Also, the flow rate of primary gas is less than 45 l/minute or more than 55 l/minute, the powders will be transferred through the outer portion, but not the central portion of the plasma arc so that the uniform spraying of the powders will not be possible.

The plasma spraying of the powders under such conditions allows the production of the thin sheet of the composite material containing a high fraction of the reinforcing material, which was difficult to be produced by the prior art. Furthermore, the thin sheet of the composite material produced according to the present invention has high heat transfer coefficient, low thermal expansion coefficient, and very excellent machinability, and thus is very suitable for use as the thermal management material for electronic devices. Particularly, in producing the thin sheet of the composite material according to the present invention, the desired properties can be designed according to the kind and volume fraction of selected reinforcing material powders.

The present invention will be described hereinafter in further detail by examples. It should however be borne in mind that the present invention is not limited to or by the examples.

EXAMPLE 1

Pure aluminum powders having an average particle size of about 24 μm and SiC powders having an average particle size of about 17 μm were dry-mixed with a stirrer at a volume fraction of 50:50, thereby producing spraying powders. The produced spraying powders were dried at 150° C. for one hour to remove water. The produced spraying powders were laminated on a graphite substrate of a 300 mm×200 mm size by plasma arc of about 23 kW. This plasma spraying operation was carried out under the conditions given in Table 1 below.

TABLE 1

| | |
|---|---|
| Arc current (A) | 380–420 |
| Arc voltage (V) | 55–65 |
| Arc power (kW) | 21–27 |
| Flow rate of primary gas (Ar, l/min) | 45–55 |
| Interval between nozzle and substrate(mm) | 110–130 |
| Moving speed of spray gun (mm/sec) | 30 |
| Transfer rate of powders (g/min) | 20–30 |

Figure 2:
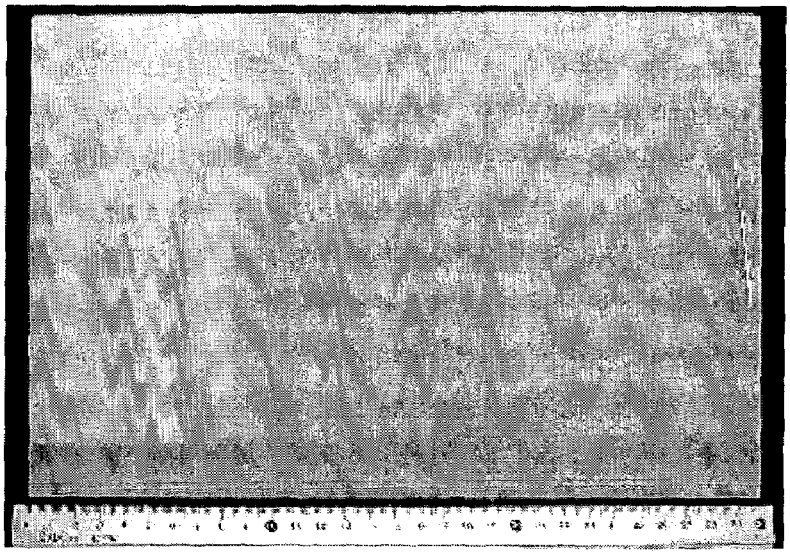
FIG. 2 shows the shape of a thin sheet of an Al—SiC composite material, which is produced according to Example 1 of the present invention.
Figure 3:
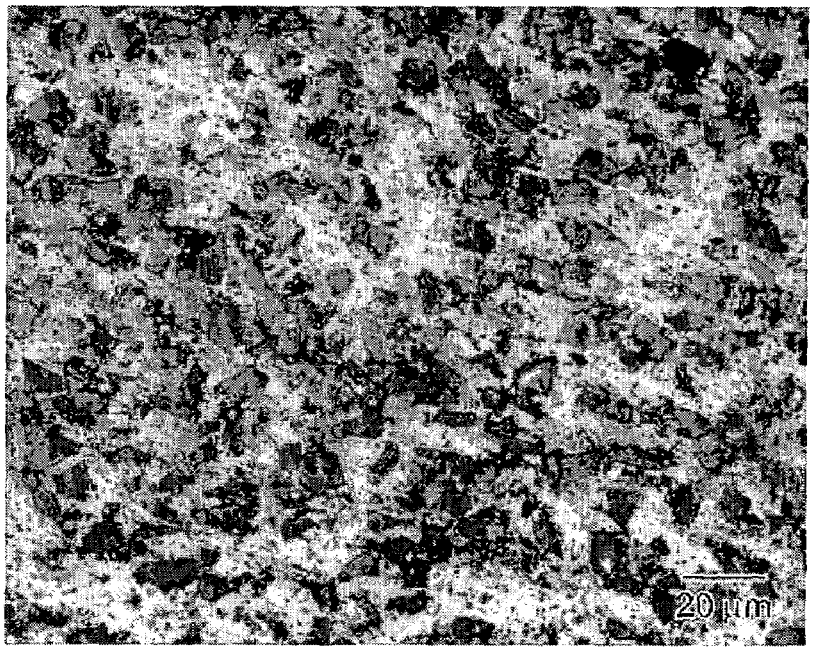
FIG. 3 is a photograph showing the microstructure of a composite material produced according to Example 1 of the present invention.

FIG. 2 shows the shape of the thin sheet of the Al—SiC composite material produced according to Example 1, and FIG. 3 shows the microstructure of the thin sheet produced according to Example 1. As can be seen in FIG. 2, an Al—SiC composite material of a thin sheet shape having a length of 300 mm, a width of 200 mm and a thickness of 1–2 mm could be produced according to the present invention. As can be seen in FIG. 3, the volume fraction of SiC powders in the composite material was about 46%, which exhibits the uniform distribution of the SiC powders.

Moreover, the Al—SiC composite material produced according to the present invention was substantially measured for its thermal expansion coefficient and thermal conductivity. The results are given in Table 2 below. In case of composite materials, thermal expansion coefficient and thermal conductivity can be theoretically calculated according to the fraction of a reinforcing metal and a matrix metal. Thus, the theoretical thermal expansion coefficient and thermal conductivity for the composite material produced according to the present invention were calculated for comparison with the theoretical values.

TABLE 2

| | Measured value for Example 1 | Theoretical value 1 (Kerner Model & Maxwell) | Theoretical value 2 (Rule of Mixture) |
|---|---|---|---|
| Thermal expansion coefficient ($10^{-6}$/° C.) | 14.1 | 14.2 (Kerner's) | 14.9 |
| Thermal conductivity (W/m · K) | 172.5 | 174.7 (Maxwell's) | 179.3 |

From Table 2, it could be found that the measured values of thermal expansion coefficient and thermal conductivity for the composite material of the present invention were similar to the theoretical values.

EXAMPLE 2

Figure 4:
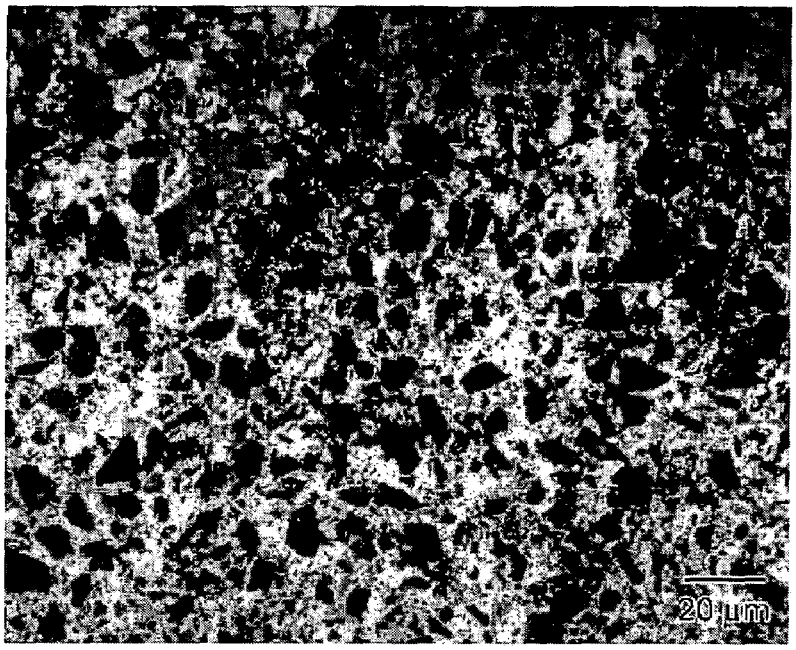
FIG. 4 is a photograph showing the microstructure of a composite material produced according to Example 2 of the present invention.

Pure aluminum powders having an average particle size of 45 μm and SiC powders having an average particle size of 17 μm were charged into a stainless steel jar at a volume fraction of 30:70. Zirconia ($ZrO_2$) balls were added to the powders, which were then mixed at 90 rpm for about 7 hours according to a simple rotation method, thereby producing spraying powders. At this time, stearic acid as a processing aid was added at the amount of 1.5% by weight relative to the weight of the spraying powders, and the weight ratio between the balls and the powders was 10:1. After ball milling, the mixed powders were dried for about 4 hours at 150° C. to remove water and the processing aid, and coarse powders were removed using a sieve of an 80-mesh size. The spraying powders provided as described above were sprayed on a graphite substrate of a 100 mm×100 mm size by plasma arc, thereby producing a thin sheet of the composite material having a thickness of about 2 mm. FIG. 4 shows the microstructure of the thin sheet of the Al—SiC composite material produced according to Example 2.

As shown in FIG. 4, the thin sheet of the composite material produced according to the present invention had a SiC volume fraction of about 66%, which shows the uniform distribution of the SiC powders.

Moreover, the measurement of thermal expansion coefficient and thermal conductivity for the composite material showed a thermal expansion coefficient of $9.1\times10^{-6}$/° C. slightly lower than a theoretical value (Kerner Model; $10.0\times10^{6}$/° C.), and a thermal conductivity of 148 W/m·K lower than a theoretical value (Maxwell Model; 153 W/m·K). The reason why the measured values differ from the theoretical values is that, in case of the theories, the reinforcing material was present as independent particles, whereas in case of Example 2, the contact between particles was increased due to an increase in SiC volume fraction so that the ratio of the SiC powders present as independent particles was reduced.

Figure 5:
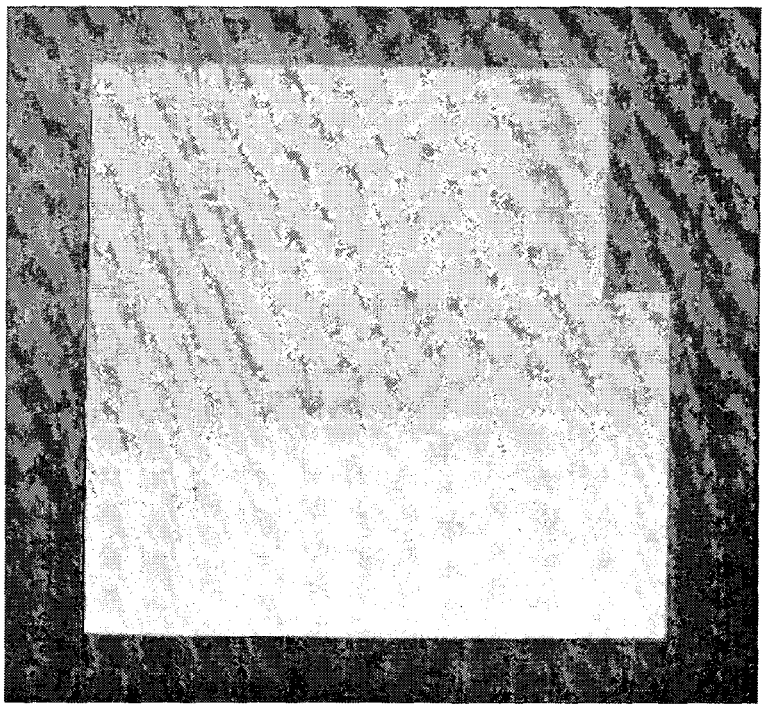
FIG. 5 shows the cut shape of a thin sheet of a composite material, which is produced according to Example 2 of the present invention.

Meanwhile, FIG. 5 shows the cut shape of the thin sheet made of the Al—SiC composite material produced according to the above method, which was cut with a cutting wheel. A high volume fraction SiC-reinforced composite material produced according to prior methods had difficulty in its cutting and processing. On the other hand, as shown in FIG. 5, the composite material produced according to the present invention had thin thickness so that it could be cut with the conventional cutting wheel. As a result, it can be found that the composite material of the thin sheet shape produced according to the present invention can be sufficiently cut without using diamond or laser cutting, so that its cutting costs will be reduced.

As described above, according to the present invention, the thin sheet of the composite material, which was difficult to be produced by the prior art, can be produced through a simple process using plasma spraying. The thin sheet of the composite material produced according to the present invention has high heat transfer coefficient and low thermal expansion coefficient, and thus, is useful as the heat management material for electronic devices, etc.

While the present invention has been described with reference to the particular illustrative examples, it is not to be restricted by the examples but only by the appended claims. It is to be appreciated that those skilled in the art can change or modify the examples without departing from the scope and spirit of the present invention.

What is claimed is:

1. A method for producing a sheet of an Al—SiC composite material for thermal management of electronic devices, which comprises the steps of:

mixing aluminum powders and SiC powders to give spraying powders;

plasma-spraying the spraying powders on a graphite substrate to form a sheet; and peeling the sheet from the graphite substrate, wherein the spraying powders contain the SiC powders at the amount of 50% to 70% by volume, the plasma spraying step is carried out under conditions where the interval between a spray nozzle and the substrate is 110 to 130 mm, the transfer rate of the spraying powder is 20–30 g/min, the flow rate of primary gas is 45–55 l/min, and plasma arc power is 20 to 40 kW.

2. The method according to claim 1, wherein the sheet is formed in a thickness of from about 1 mm to about 2 mm.

* * * * *